United States Patent [19]

Reichert

[11] 4,303,405

[45] Dec. 1, 1981

[54] APPARATUS FOR FORMING AND INSERTING PARTITIONS INTO CONTAINERS

[75] Inventor: Donald G. Reichert, Tarpon Springs, Fla.

[73] Assignee: ABC Packaging Machine Corporation, Tarpon Springs, Fla.

[21] Appl. No.: 21,349

[22] Filed: Mar. 19, 1979

[51] Int. Cl.[3] ..... B31B 11/02

[52] U.S. Cl. ..... 493/92; 493/90

[58] Field of Search ..... 93/37 R, 37 SP, 36 M; 229/15, 42

[56] References Cited

U.S. PATENT DOCUMENTS

| | | | |
|---|---|---|---|
| 1,799,656 | 4/1931 | Tinsley | 229/15 X |
| 3,777,630 | 12/1973 | Roda | 93/37 R |
| 4,133,253 | 1/1979 | Butt | 93/37 R |
| 4,151,788 | 5/1979 | Wiseman | 93/37 R |
| 4,154,148 | 5/1979 | Weremiczyk et al. | 93/37 SP |
| 4,164,312 | 8/1979 | Harned | 229/15 |

*Primary Examiner*—Gus T. Hampilos

*Attorney, Agent, or Firm*—Newton, Hopkins & Ormsby

[57] ABSTRACT

A magazine carries a plurality of flat, stacked, corrugated fiber-board partition blanks, each being cut and scored for folding into an "H" partition. The flat blanks are successively removed, one at a time, by a suction stripper feed mechanism which transfers them to a conveyor which, after the end panels of each partition are folded 90° by plows, delivers each partition in a longitudinal path to a carrier in a forming station. A vertically moveable forming head folds the blank transversely about opposed fingers and strips the blank from the carrier, downwardly. Then the folded blank passes through opposed converging plates where the panels are urged against each other and opposed reciprocating flap folding dies fold the flaps to acute angles with respect to the panels. Next, the panels pass between spring-loaded twist members to urge them to deflected positions and are, thereafter, delivered diagonally into an open container where, after about 75% of the blank is inserted, the twister assembly twists the same into an aligned position. Subsequently, a squaring head forces the flaps against the ends of the container and thereby disposes of the U-shaped partition members formed by the panels, parallel to and between the sides of the container.

21 Claims, 13 Drawing Figures

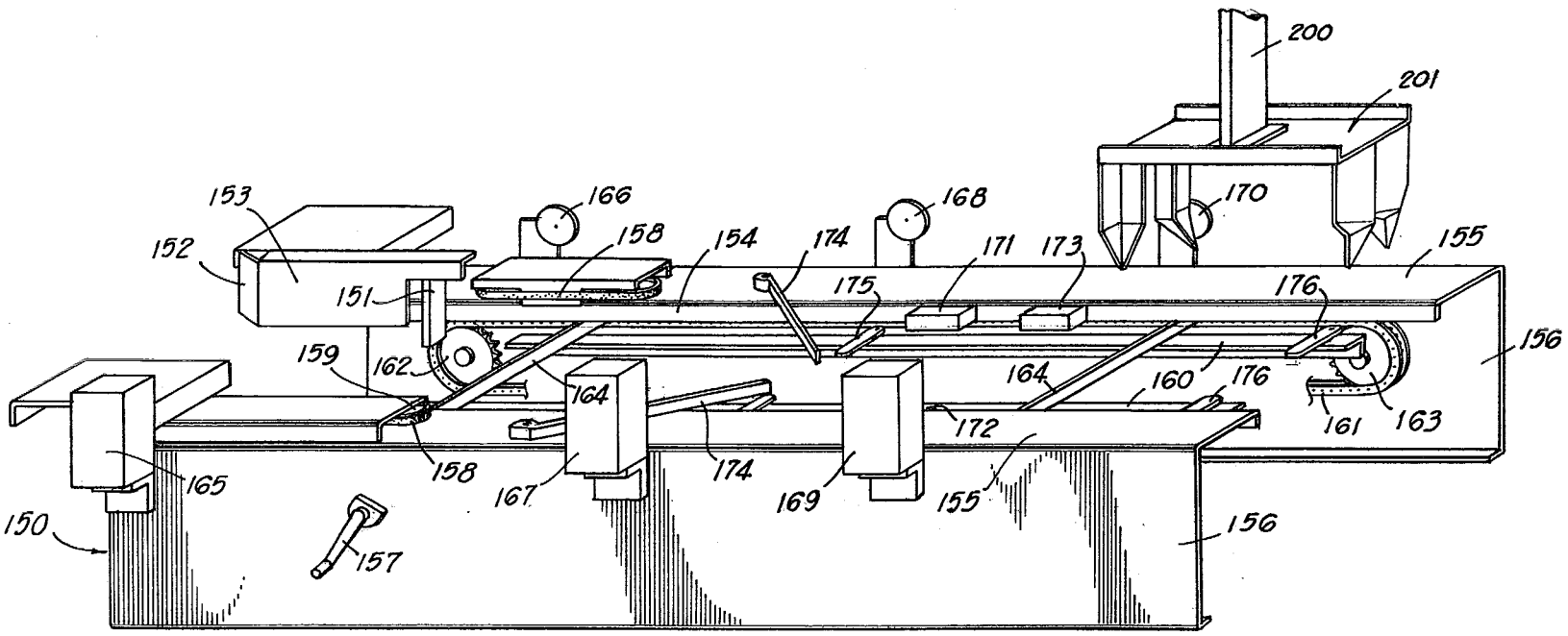
FIG 8
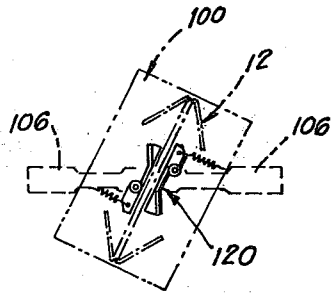
FIG 5
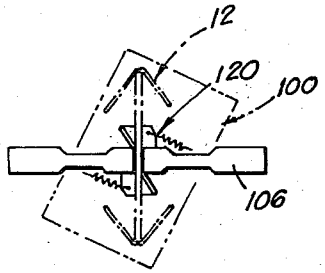
FIG 4
FIG 3
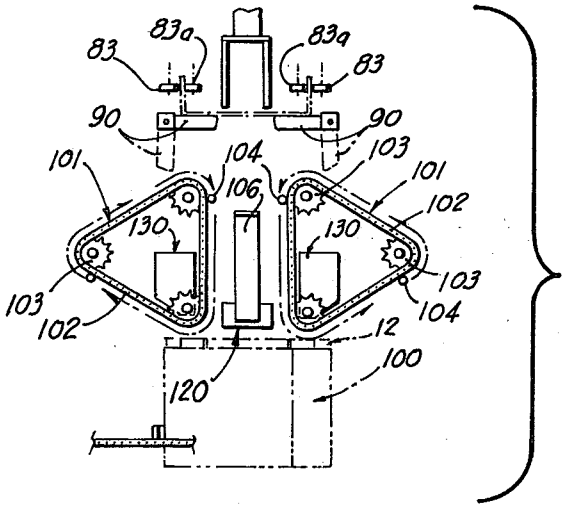

APPARATUS FOR FORMING AND INSERTING PARTITIONS INTO CONTAINERS

BACKGROUND OF THE INVENTION

1. Field of the Invention

This invention relates to a partition former and inserter for containers and is more particularly concerned with an apparatus for and method of forming and inserting partitions into containers.

2. Description of the Prior Art

In the past, many machines have been devised for inserting partitions into containers. The following U.S. patents disclose typical prior art machines for creating and inserting partitions:

U.S. Pat. No. 4,034,656
U.S. Pat. No. 4,019,427
U.S. Pat. No. 3,952,633
U.S. Pat. No. 3,838,812
U.S. Pat. No. 3,818,812
U.S. Pat. No. 3,813,999
U.S. Pat. No. 3,685,401
U.S. Pat. No. 3,580,471
U.S. Pat. No. 3,576,574
U.S. Pat. No. 3,483,802
U.S. Pat. No. 3,296,758

One basic problem with the prior art procedures was the requirement for close registry between the partitions being inserted and the case or container receiving the insert. This problem also prevented a snug fit between the partition and case. The problem was particularly acute where the container had hand holes which might block the free insertion of the partition.

SUMMARY OF THE INVENTION

Briefly described, the apparatus of the present invention includes a magazine elevator into which a stack of rectangular partition blanks are loaded in a vertical stack. The lateral edge portions of each blank is notched from opposite sides and scored between the notches along a transverse centerline. The blank is also scored longitudinally to separate the side flaps from the center panels.

A vacuum cup stripper disposed above the uppermost blank engages the top blank, lifts it and moves it sidewise or longitudinally onto a belt conveyor and returns for the next top blank. Hold down rollers hold the blank on the conveyor as it is moved longitudinally so that opposed plows on opposite sides of the conveyor fold the flaps upwardly through 90° along their longitudinal fold lines.

Thence, the folded blank is passed to a carrier in a forming station where the blank is supported by opposed fingers and also by its flaps with the body of the blank beneath a vertically moveable forming head. When the head is moved downwardly, its dies engage the two panels of the body and folds them about the fingers, along the transverse scoreline, sufficiently for the flaps to be stripped from the carrier and fed downwardly to opposed vertical conveyors and through opposed downwardly converging camming plates, which force the panels flat against each other as the blank is moved, downwardly. Pneumatic cylinders on opposite ends of the blank move U-shaped dies inwardly to further fold the flaps of the blank to acute angles with respect to the partition member formed by these panels.

The opposed conveyors then progressively feed the folded partition, formed from the blank, downwardly into a container or case which is angularly or diagonally positioned, therebeneath, by a case or container conveyor.

Below the converging plates is a twist member having spring-biased turning fingers or members which are cammed to their biased positions by the downwardly moving partition and, thus, when the partition is about 75% within the container, the fingers twist the partition member to align it with the container as the partition member leaves the plates.

The container conveyor then moves the container and its partition beneath a reciprocating squaring head which has camming lugs for urging the flaps against the inner surfaces of the ends of the case.

Accordingly, it is an object of the present invention to provide an apparatus for forming and inserting partitions into containers, the apparatus being inexpensive to manufacture, durable in structure, and efficient in operation.

Another object of the present invention is to provide a method of forming and inserting partitions into containers whereby the partition is snugly and accurately disposed within the container.

Other objects, features and advantages of the present invention will become apparent from the following description when taken in conjunction with the accompanying drawings wherein like characters of reference designate corresponding parts throughout the several views.

BRIEF DESCRIPTION OF THE DRAWINGS

FIG. 3 is a vertical sectional view taken substantially along line 3—3 in FIG. 2;

FIG. 4 is a horizontal sectional view taken substantially along line 4—4 in FIG. 2;

FIG. 5 is a horizontal sectional view taken substantially along line 5—5 in FIG. 2;

DESCRIPTION OF THE PREFERRED EMBODIMENT

Figure 1:
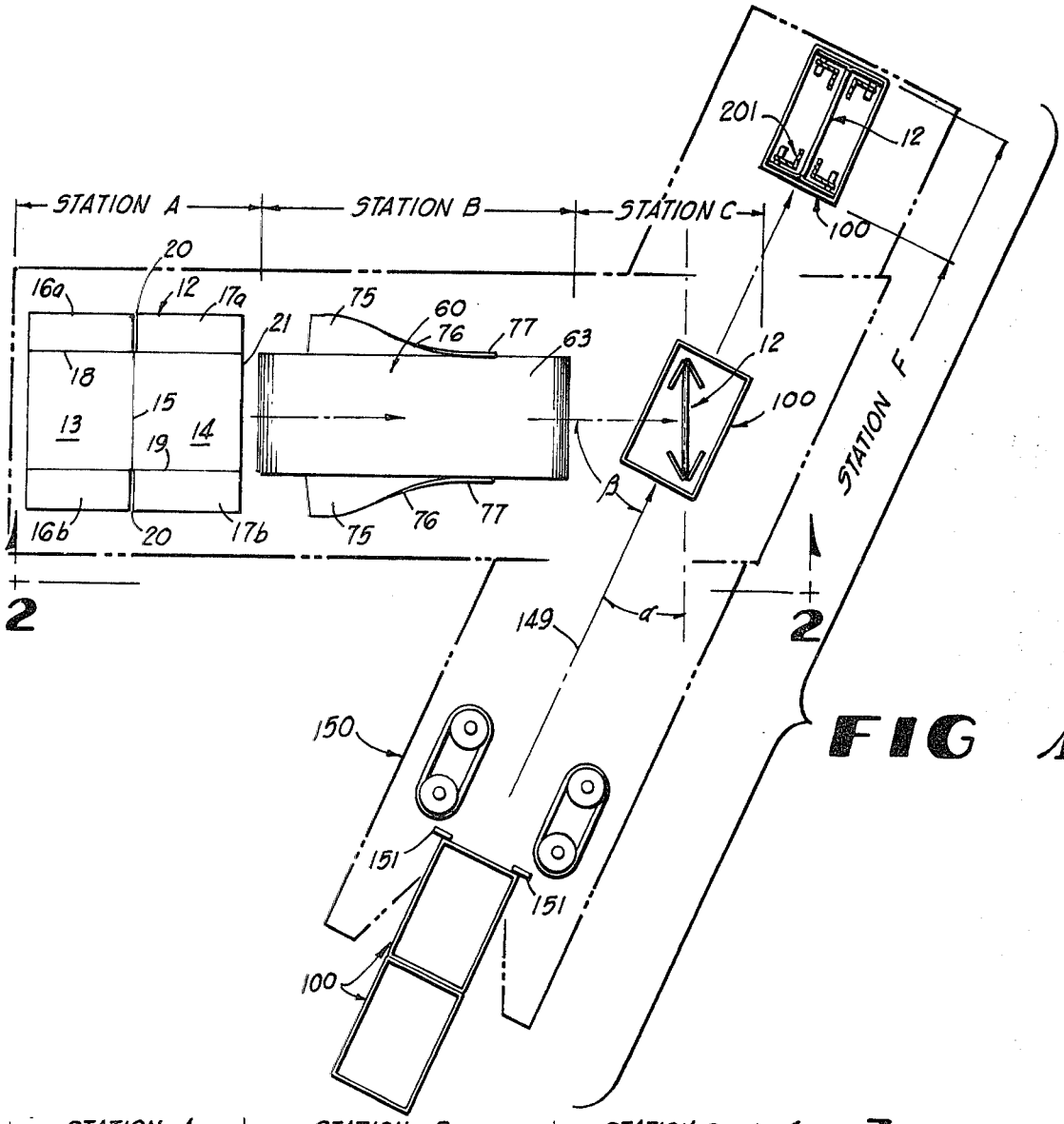
FIG. 1 is a schematic plan view of an apparatus for forming and inserting partitions into containers, the apparatus being constructed in accordance with the present invention.
Figure 2:
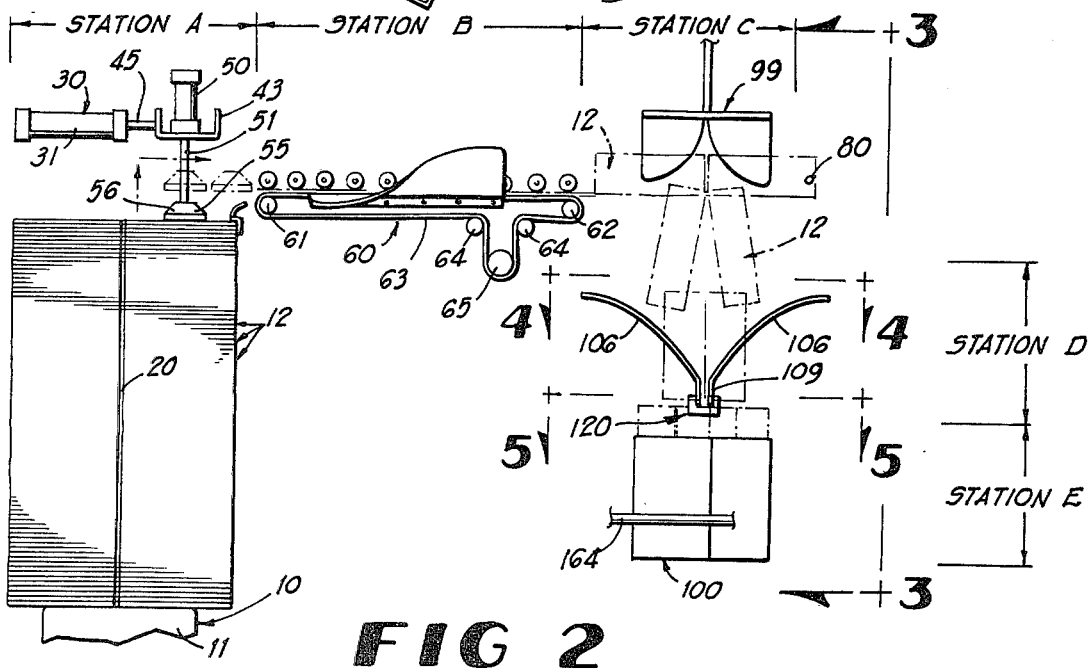
FIG. 2 is a vertical sectional view taken substantially along line 2—2 in FIG. 1.

Referring now in detail to the embodiment chosen for the purpose of illustrating the present invention, numeral 10 denotes a magazine elevator, in magazine station A, which includes a magazine platform 11, on which are loaded a vertical stack of partition blanks 12. Each partition blank 12, as seen in FIG. 1, is a rectangular or square corrugated fiber-board sheet which is cut and scored to provide a pair of body panels 13 and 14, which are separated by a common transverse edge or transverse score line 15. On opposite sides of the panel 13 are a pair of opposed sidewise protruding flaps 16*a* and 16*b*. On opposite sides of the panel 14 are a pair of opposed sidewise protruding flaps 17*a* and 17*b* aligned with flaps 16*a* and 16*b*, respectively. These flaps 16*a* and 16*b* are integrally connected, respectively, to the panels 13 and 14 being separated therefrom by a longitudinally extending score line 18, which is parallel to and inwardly of the side edge of the blank 12. In like fashion, the panels 17*a* and 17*b* are integrally connected to the panels 13 and 14 by a score line 19 which is parallel to the score line 18 and is inwardly of the other side edge of the blank. Outwardly opening notches 20 separate the panels 16*a* and 17*a* and 16*b* and 17*b*, these notches 20 being aligned with the transverse score line 15. The flaps 16*a*, 16*b*, 17*a* and 17*b* are all of equal size and shape and the panels 13 and 14 are of equal size and shape. Each is rectangular.

The magazine elevator 10 urges the stack of blanks 12 upwardly so that the uppermost blank 12 is always disposed at a prescribed plane for ready removal by a vacuum stripper assembly, denoted generally by the numeral 30.

Figure 6:
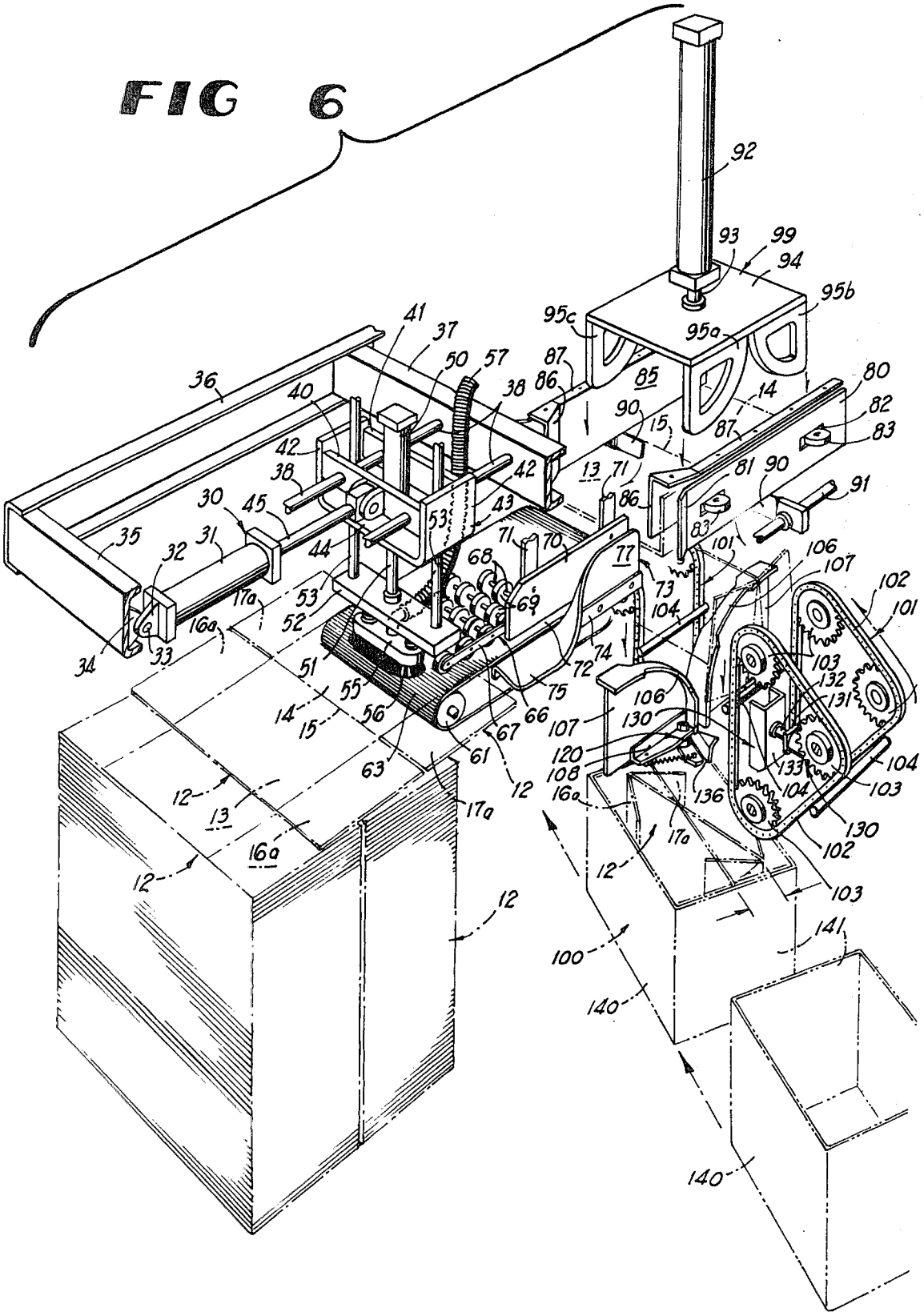
FIG. 6 is an enlarged, perspective view of the partition forming and inserting assembly of the device depicted in FIG. 1.

In more detail, the vacuum stripper assembly 30 is disposed over the magazine elevator 10 and includes, as best seen in FIG. 6, a generally horizontal disposed double acting pneumatic cylinder 31, the rear end portion of which is provided with a bracket 32, pivotally mounted by means of pivot pin 33 to a bracket 34 on a crossbar 35 of the frame of the machine. The crossbar 35, in turn, is carried by the longitudinal struts, such as strut 36 of the frame. A second crossbar 37 is also carried by strut 36 and disposed forwardly of the crossbar 35 and in parallel relationship thereto. Parallel slide rods 38 extend longitudinally between and have their ends fixed to the crossbars 35 and 37 and straddle cylinder 31.

Slideably carried by slide rods 38 are a pair of spaced parallel transverse ribs 40 and 41, the ends of which are secured to the transversely opposed, vertically disposed end plates 42 of a U-shaped cradle, denoted generally by the numeral 43. The cradle 43 includes a flat cross plate 44 carried by the lower edges of the opposed vertically disposed end plates 42.

The piston rod 45 which extends out of the cylinder 31 is provided, within the cylinder, with an appropriate piston (not shown). The outer end of the piston rod 45 is pivotally connected to the slide plate 40, so that, when the piston rod 45 is extended or retracted, the cradle 43 will be moved longitudinally, the slide bars 40 and 41 sliding on the rods 38.

The cross plate 44 of cradle 43 carries a vertically disposed hydraulic cylinder 50 which is provided with a piston rod 51, the inner end of which is connected to a piston (not shown) within the cylinder 50 and the outer end of which extends downwardly through the plate 44 with its end connected to a support plate 52. Disposed on opposite sides of the piston rod 51 and carried by plate 52 are a pair of upstanding guide rods 53 which are slidably journalled by the cross plate 44. By actuation of the cylinder 50, the support plate 52 may be raised and lowered, vertically, as desired.

Suspended from the plate 52 is a vacuum cup assembly which includes a vacuum head 55 and flexible vacuum cups 56 carried by the lower surface of the head 55. A vacuum hose 57 is connected to the head 55 so as to draw a vacuum through the flexible cups 56, the vacuum being sufficient to enable the cups 57 when contacting the uppermost blank 12 to lift it from the stack when cylinder 50 is appropriately actuated.

In operation, when it is desired to pick up a blank 12, the piston rod 45 is retracted and the piston rod 51 is extended so that the vacuum cups 56 engage the upper surface of the uppermost blank 12 along panel 14, thereof. By rearward movement of the piston rod 45, the uppermost blank 12 is inserted onto the upper flight of a horizontal linear conveyor, denoted generally by the numeral 60, in a flap folding station B. The infeed end of conveyor 60 is adjacent to one side of the magazine elevator 10. The vacuum is then released.

The conveyor 60 includes pairs of drums or rollers 61 and 62 disposed on transverse axes horizontally aligned in spaced, parallel relationship, the rear drum or roller 62 being driven and the drum or roller 61 being an idler roller. A continuous belt 63 extends around these rollers 61, 62 to provide an essentially flat upper flight and a lower flight of which passes over a pair of adjacent, transverse disposed, idler rollers 64, and downwardly to receive a take-up roller 65 which, through its weight, applies tension continuously on the belt 63. The width of belt 63 is approximately equal to the width of panels 13 and 14.

Disposed above the upper flight of the belt 63 is a hold-down assembly, denoted generally by the numeral 66. This hold-down assembly pivotally floats on top of the upper flight of the belt 63 so as to hold the panels 13 and 14 of blanks 12 in engagement with the upper flight of belt 63, as it is moved through the flap folding station B.

In more detail, the hold-down assembly includes a pair of opposed, longitudinally extending, rod supporting bars 67 which carry, therebetween, a plurality of spaced, parallel, transversely extending, wheel-supporting rods 68. Each wheel-supporting rod 68 carries for rotation a plurality of spaced, individually freely rotatable, skate wheel-type rollers or wheels 69, which ride upon the upper surface of the upper flight of belt 63.

The down stream ends of the longitudinally extending bars 67 are inwardly adjacent to and pivotally connected to a pair of transversely opposed, parallel, vertically disposed, fold plates 70, which are, in turn, carried in fixed positions by the frame by means of downwardly extending brackets 71. Thus the assembly 66 can pivot upwardly when a panel 12 is inserted on the belt 63.

The fold plates 70 have straight lower edges 72 which are disposed parallel to and spaced above the upper flight of belt 63 by a distance slightly greater than the thickness of the blank 12, the edges of it being generally aligned respectively with the edges of belt 63, so as to provide platens against which the flaps 16*a*, 16*b*, 17*a* and 17*b* are folded as the blank 12 is moved in a longitudinal direction through station B.

Outward adjacent to the plates 70 are a pair of side flap folders or plows 73, which are supported in fixed positions by longitudinally extending struts 74. The upstream end portions of the plows 73 form transversely opposed, sidewise extending horizontally disposed, flap receiving plates 75, which merge with opposed progressively upwardly curved, camming members or surfaces 76, which, in turn, merge with vertical plates 77. The vertical plates 77 are outwardly adjacent to the plates 70 to define passageways for flaps 16*a*, 16*b*, 17*a* and 17*b* as they pass from the flap folding station B into the forming station C.

The width of the belt 63 is about equal to the distance between the score lines of 18 and 19 of the panels 13 and 14 while the distance between the edges, such as edge 72, of the vertical plates 70 is approximately equal to the transverse distance between the score lines 18 and 19. The inner edges of the flap receiving plates 75 are outwardly adjacent to the outer edges of the upper flight of belt 63 so that, as the blank 12 is carried downstream by the belt 63, the flaps 16*a*, 16*b* and 17*a*, will ride over the horizontal plates 75 and then be progressively bent upwardly by about 90° around the edges of 72 by the curved camming members 76. Thus, as the blank 12 emerges from station B, it is U-shaped or channel-shaped, as depicted by broken lines in FIG. 6. As such, it is fed into the forming station C.

The function of the apparatus of forming station C is to bend the panels 13 and 14 transversely about the transverse score line 15, so as to form an H-partition, which is then stripped downwardly through a shaping station D and into the container or carton 100 in a partition inserting and rotating station E.

In more detail, in forming station C are a pair of spaced, opposed, parallel, flat, rectangular, longitudinally extending, vertically disposed, outer guide plates 80 provided, at their upstream ends with diverging flap guiding flanges 81. These guide plates 80 are generally aligned with the plates 77, so that, as the U-shaped blank 12 is discharged from the belt 63, the flaps 16*a*, 16*b*, 17*a* and 17*b* will be received along the inner surfaces of the plates 80. In each plate 80 are a pair of access openings 82, through which protrude the inner peripheral portions of support wheels or rollers 83. These support wheels 83 are rotatable about vertical axes and are spring loaded, inwardly.

Inwardly adjacent and parallel to the plates 80 are the inner guide plates 85, the upstream end portions of which are provided with diverging flap guiding flanges 86. The upper edges of the vertically disposed inner guide plates 85 are provided with outwardly turned flanges 87. The flap guiding flanges 86 are respectively opposite to the flap guiding flanges 81, while the plates 85 are respectively opposite the plates 80, so as to receive the flanges 16*a*, 16*b* and 17*a*, 17*b*, therebetween. The guide plates 85 carry wheels or rollers 83*a*, the inner peripheries of which cooperate with rollers 83 to yieldably support flaps 16*a*, 16*b*, 17*a* and 17*b*.

Substantially midway of and below the lower edges of the pairs of plates 80, 85 are the fold fingers 90, which are aligned transversely with each other and protrude inwardly and below the partition 12 in station C.

Each finger 90 is supported at its outer end portion by a longitudinally extending shaft 91 so that when the blank 12 is stripped downwardly, the fingers 90 will resist such movement sufficiently to permit a folding action along the transverse scoreline 15 while thereafter pivoting sufficiently to permit the stripping of the blank 12 downwardly from station C into shaping station D.

For achieving this folding and stripping action, the frame of the machine is provided with a vertically disposed cylinder 92 provided with a piston rod 93. The lower outer end of piston rod 93 is provided with a forming head 99 having a flat, rectangular die base 94. Protruding downwardly from the lateral edge portions of the die base 94 are pairs of longitudinally aligned transversely opposed die members, such die members 95*a*, 95*b* and 95*c*. Each die member 95*a*, 95*b*, and 95*c*, has an arcuate surface extending through an arc of approximately 90° curving inwardly so as to terminate adjacent to each other at the base 94. The die members 95*a* and 95*c* are in transverse alignment while the die members, such as die member 95*b*, are also in transverse alignment, whereby the die members define a central transverse valley which, when a blank 12 is received in station C, is aligned with the score line 15 thereof.

The inner end of piston rod 93 is provided with a piston (not shown) riding within the cylinder 92, so that upon actuation of the cylinder 92, the rod 93 will be extended downwardly, whereby the corner portion of the dies, such as dies 95*a*, 95*b* and 95*c*, engage the panels 14 and 15 and, upon further movement of the rod 93, downwardly, will progressively engage the more inner portions of panels 14 and 15 is thereby fold the body of the partition blank 12 about the score or fold line 15. Such downward movement of the dies, such as 95*a*, 95*b*, and 95*c*, will cause the flaps 16*a*, 16*b*, 17*a*, 17*b*, to be stripped downwardly from their held positions, between wheels 83, 83*a*, as the panels are folded inwardly toward each other, and as the fingers 90 hold the blank 12. Further movement of the dies, such as dies 95*a*, 95*b* and 95*c*, will strip the partition 12 out of the fingers 90 as they pivot downwardly for releasing the blank 12.

Vertically below the folding station C is the shaping station D which includes a pair of opposed vertical conveyor members, denoted generally by numeral 101. In more detail, each conveyor member 101 includes a pair or continuous chains 102 supported by three sprockets 103 to provide a pair of longitudinally aligned, vertical, inner flights for the chains 102.

Each pair of chains 102 are provided with a plurality of horizontally disposed, longitudinally extending, bars 104. The ends of the feed bars 104 are secured to the pair of chains 102. The laterally opposed, pairs of conveyors 101 are driven in opposite directions so that the inner flights of the chains 102 are disposed vertically on opposite sides of the station D whereby opposed pairs of the horizontally disposed bars 104 engage the end portions of the upper edges of the H shaped partition formed by the blank 12 and positively move it downwardly in station D.

Disposed midway between the opposed pairs of conveyors 101 and vertically below the die or forming head 99 are a pair of opposed arcuate, inwardly and downwardly converging, camming members having arcuate plates 106 which are curved to form a radius of approximately 90°, downwardly curved toward each other to terminate in parallel, opposed panel holding plates 109 at their lower end portions. Plates 106 and 109 cooperate so as to urge the folded panels 13 and 14 into contiguous relationship with each other as they pass therebetween.

The plates 106 are respectively supported on upstanding support panels 107, which are disposed in longitudinal alignment midway of the frame. These support panels 107 are, in turn, provided at their lower edge portions with angle irons 108, connected approximately to the frame so as to fix the location of the panels 107.

Opposed plates 109 are spaced apart by approximately the thickness of the two panels 13 and 14, so as to maintain these panels in their contiguous relationship as the bars 104 engage the upper common edge, formed by the score line 15, to urge the folded panels 13 and 14, downwardly.

Figure 9:
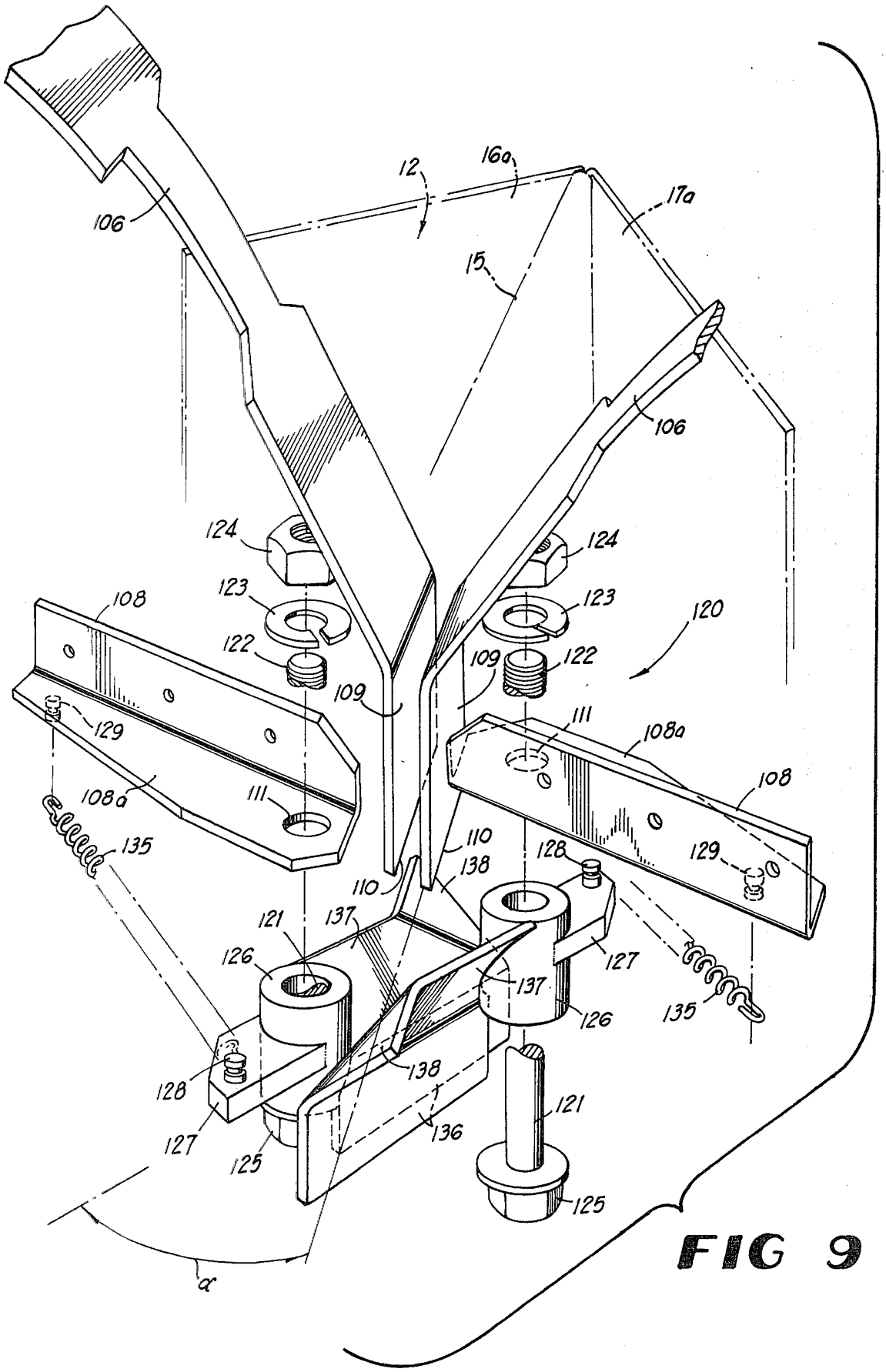
FIG. 9 is an enlarged, exploded, perspective view of a detail showing the converging camming plates and the twisting fingers of the machine shown in FIGS. 1-8.
Figure 10:
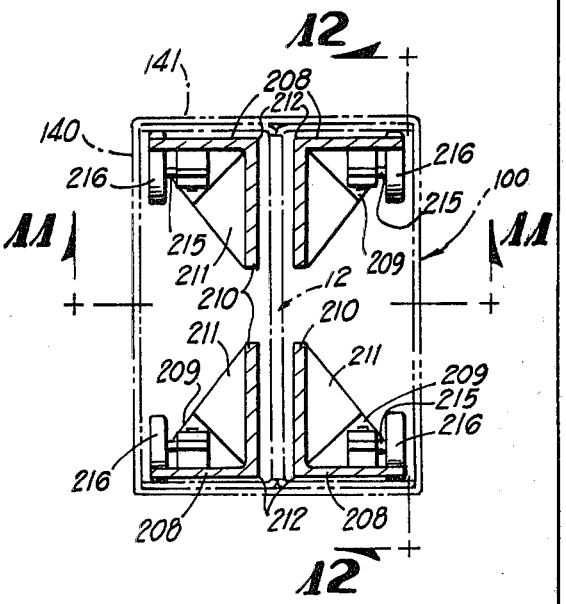
FIG. 10 is a cross-sectional view of the squaring head of the device shown in FIGS. 1-9.

Carried by the angle irons 108 is a twister assembly 120, best seen in FIG. 9, the function of which is to twist the juxtaposed panels 13 and 14 through angle $\alpha$ of approximately 25° after the upper common edge formed by score line 15 clears the bottom edges 110 of the plates 109. In more detail, the twist assembly 120 includes a pair of parallel, vertically disposed pivot pins 121, which are respectively received through holes 111 in the horizontal flanges 108*a* of the angle irons 108. The upper ends of the pivot pins 121 are externally threaded, at numeral 122, and receive, thereon, the lock washers 123 and the nuts 124. The lower end portions of the pivot pins 121 are provided with enlarged heads 125, the upper surfaces of which provide bearing surfaces for the pair of tubular bearing members 126 which are respectively received thereon.

Protruding radially from the bearing members 126 are the biasing levers 127 which are respectively provided with upstanding spring receiving fingers 128. The horizontal flanges 108*a* of the angle irons 108 are respectively provided with downwardly extending spring receiving fingers 129, which receive, respectively, the ends of the springs 135. The other ends of the springs 135 are respectively connected to the fingers 128. The springs 135 are in tension so as to bias the bearing members 126 at all times.

Protruding from the bearing members 126 in a diametrically opposite directions from the levers 127 are the twist members which include flat, vertical, twisting plates 136, the inner surfaces of which are normally about parallel and in a plane about 25° from the planes of the plates 109. Through the biasing of spring 135, plates 136 are urged against the outer periphery of the opposite bearing member 126, which arrests the rotation thereof in its 25° rotated position.

The upper edges of the plates 136 are provided with upwardly diverging guide flanges 137, the inner ends of which are respectively secured the bearing members 126. The outer corners of flanges 137 are bent outwardly to define a pair of triangular camming tabs 138. The arrangement of the shafts 121 on opposite sides of the longitudinal vertical center line of the machine and on transversely opposite sides of the plates 107 and outwardly of the plates 109 disposes the upper portion of tabs 138 on opposite sides of the transverse plane of travel of the panels 13 and 14 as they pass between the opposed, parallel plates 109 and also dispose the upper portions of these tabs 138 outwardly of and below the lower edges 110 of these plates 109. Hence, as the panels 13 and 14 are moved downwardly by the opposed pairs of bars 104, the bottom edges of the panels 13 and 14 engage the tabs 138 and, upon further downward movement of the blank 12, they move progressively downwardly on the tabs 138 so as to pivot plates 136 outwardly and eventually pass between the plates 132, as they are in their biased and pivoted positions.

Above camming platen 106 in transverse, opposed relationship, are the flap folding members, denoted generally by the numeral 130. Each flap folding members include opposed aligned double acting cylinder 131 which actuate in the usual way, a pneumatic piston rod 132, so as to extend and retract the piston rods 132, simultaneously. The piston rods 132 are transversely aligned and their outer ends are provided with U-shaped inwardly open, flap folding, dies 133, the forwardly extending flanges of which are disposed in vertical, parallel relationship.

The flap folding members 130 are disposed wholly within the path of travel of the bars 104 with the pneumatic lines (not shown) for the cylinder 131 passing through the area within a single conveyor chain 102.

The function of the flap folding members is to fold the flaps 16*a*, 16*b*, 17*a* and 17*b* to acute angles as the partitions pass downwardly through the converging plates 106. The flap folding members operate simultaneously and in timed relationship to the travel of the bars 104 so that the dies 133 are retracted during the period in which the bars 104 pass in front of the dies 133. Thus, the dies 133 are extended and retracted, prior to the time that the bars 104 which move the particular blank 12, are disposed between the dies 133.

Figure 7:
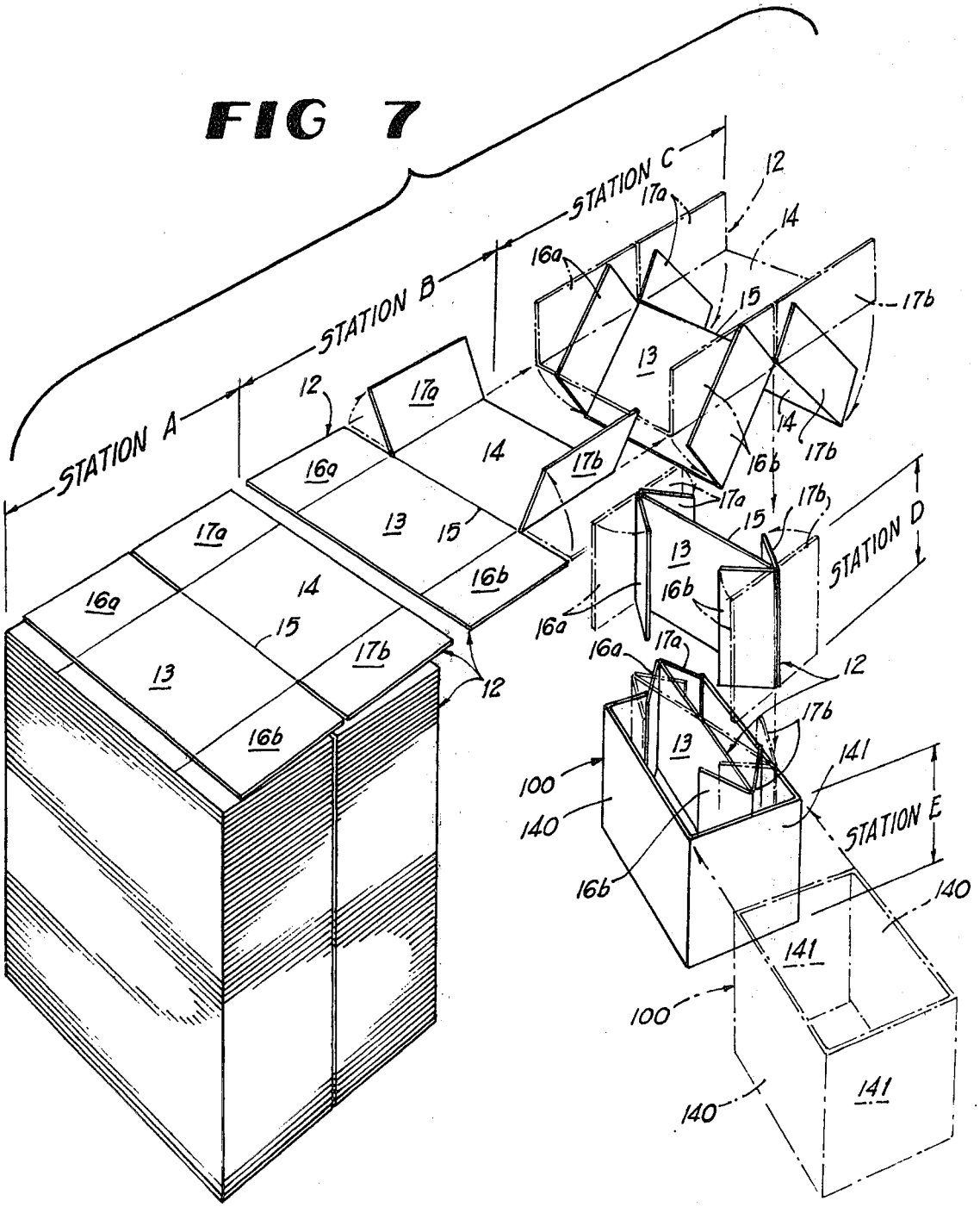
FIG. 7 is a perspective view showing the progressive shaping of successive blanks and their insertion as partitions into the container by the apparatus of the present invention.

As seen in FIGS. 6 and 7, a container, denoted generally by the numeral 100, is disposed below station D and in a station E by a container conveyor, denoted generally by numeral 150. This container conveyor 150 intermittently feeds the containers 100 along a longitudinal path 140 which is disposed at an acute angle $\beta$ of about 65° to the longitudinal axis 148 of the conveyor for the partition blanks. Thus, each container 100 is positioned vertically beneath the station D, in station E, so as to receive at the angle A of about 25°, the partition formed by blank 12. After such partition is rotated as explained above, and inserted fully within the container 100, the conveyor 150 moves the container 100 from station E to station F where the container is stopped sufficiently for the operation of the squaring head assembly to be described hereinafter.

Referring to FIG. 8, the container conveyor includes a pair of transversely opposed stops 151 which block the end of a container 100 so as to arrest the inward movement of all containers which are fed by a conveyor (not shown) to the container conveyor 150. Upstream of the stops 151, the containers 100 which are fed to the conveyor 150 pass between a pair of converging flanges 152 so as to be disposed between a pair of vertically disposed container guide plates 153 which, in turn, are carried by opposed vertically disposed supports or flanges 154. The flanges 154 are carried by a horizontal shaft and sheet metal channel (not shown), the outer edges of which are connected to the pair of opposed parallel side panels 156 connected appropriately to the frame of the machine.

A crank 157 manipulates these flanges 154 so as to move them inwardly and outwardly with respect to each other and thereby alter the distance between the flanges 154 to accommodate different widths of containers 100.

Inwardly of and below the flanges 154 are the slide bars 160 on which the edge portions of the bottom of each container 100 rides as it is moved longitudinally by the conveyor 150. The conveyor, itself, includes a pair of opposed continuous chains 161 disposed on sprockets 162 and 163 so as to provide opposed parallel upper flights for the chains 161. A plurality of transversely extending spaced flight bars 164 extend between the opposed chains 161 and protrude beneath the flanges 154 and above the slide bars 160 so as to engage the rear portion of each container as it is released by the stops 151 so as to move the container first to station E, then to station F and thereafter to discharge the container.

Figure 13:
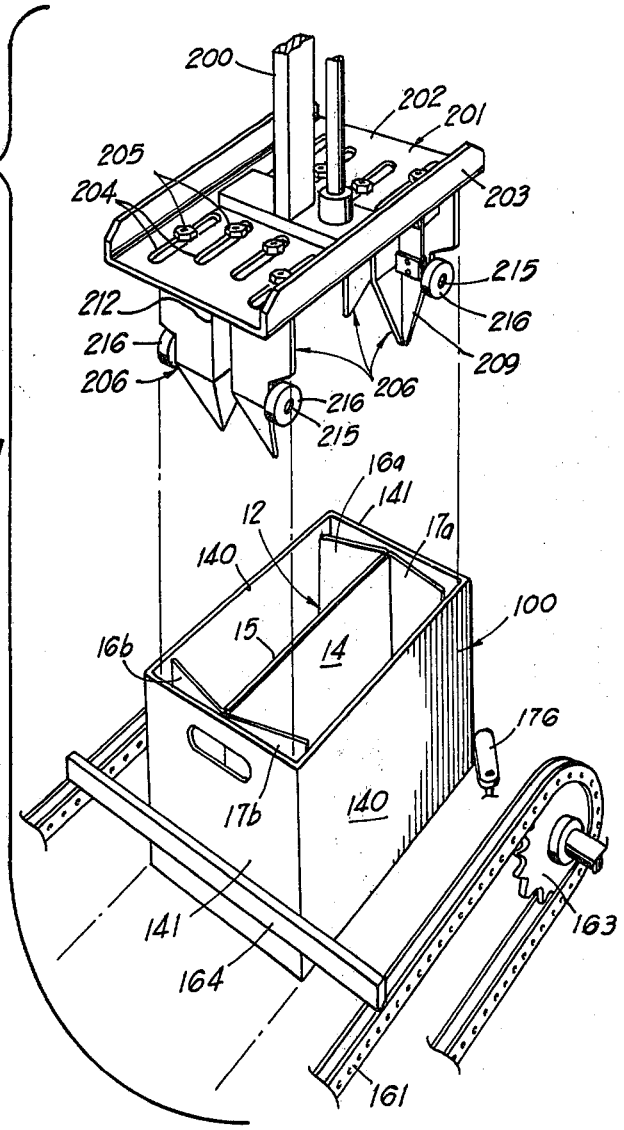
FIG. 13 is a fragmentary perspective view of the container conveyor and squaring head of the device depicted in FIGS. 1—12.
Figure 11:
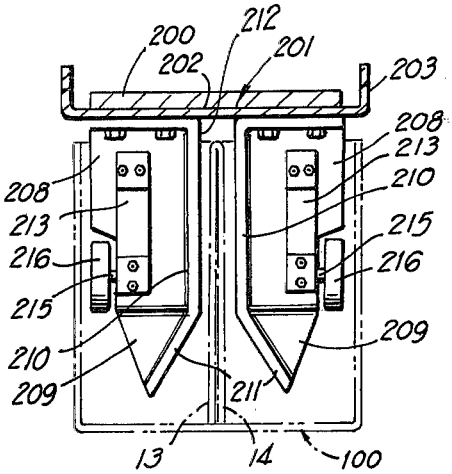
FIG. 11 is a cross-sectional view taken substantially along line 11—11 in FIG. 10.
Figure 12:
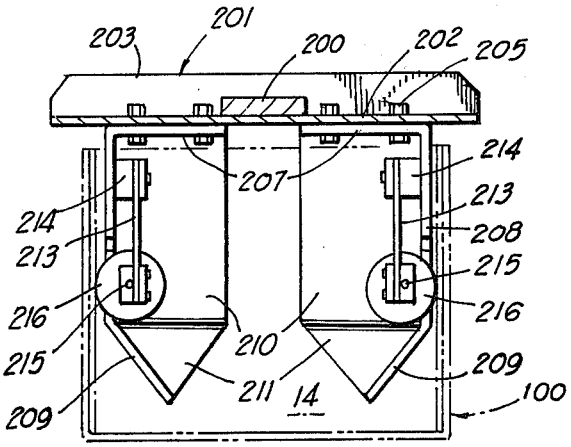
FIG. 12 is a cross-sectional view taken substantially along line 12—12 in FIG. 10.

Immediately downstream of the stops 151 are a pair of opposed side conveyors formed by continuous belts 158 passing around appropriate pulley 159. The inner flights of the belts 158 engage the sides of the container 100 so as to move it into a position where the rear portion of the container can be engaged by the flight bar 164, as depicted in FIG. 13. A photoelectric detector or electric eye assembly 165 directs light across the path of travel of the container 100 against a reflector 166 and receives this light so as to detect when a container is moved by the flight bar 164 by the conveyor 150. A second electric eye photoelectric detector or assembly 167, which directs light against a reflector 168 and receives the light back, detects when the container is in station E in a position to recceive the partition. A third photoelectric detector or electric eye assembly 169, which directs light across the conveyor to a reflector 170 and receives this light back, is for determining when the conveyor 100 is in station F.

Positioned along the path of travel of the flight bars 164 are the limit switches 171, 172 and 173. These switches detect the presence of the flight bars 164. Furthermore there are a pair of opposed spring-loaded, forwardly converging fingers 174 which, when a container 100 is in position assures that it is firmly against the flight bar 164.

The arrangement is such that when the electric eye 165 detects the presence of a container 100, and when limit switch 172 detects the presence of a flight bar 164, stops 151 are actuated s0 as to release the container for forward movement by the side conveyors 158 in timed relationship to the movement of a flight bar 164. When it reaches the fingers 174, these fingers assure that the container 100 is in an appropriate position and firmly engaging the flight bar 164. These fingers 174 and flanges 154 assume no appreciable rotation of the container 100 as the partition 12 is rotated when the beam of photoelectric sensor 167 is broken and switch 173 detects a flight bar 164, brakes are applied to the movement of the conveyors 161 so as to stop the container 100 in an appropriate position in station E to receive the partition 12.

A photoelectric sensor (not shown) detects the presence of a partition in station D so as to actuate the operation of the conveyors 101 for moving the partition downwardly, into the container 100 as described above. When it reaches approximately 75% of its downward travel, it is automatically twisted by the twister assembly so as to align the partition member formed by panels 13 and 14 with the container 100, as explained above. The finger 175 in the path of travel is moved to arrest the container and retain it in its appropriate position in station F when the photoelectric sensor 167 and the switch 173 are actuated.

After insertion of the partition fully within the container 100 by the full travel of the bars 104, stop 175 is released and the brake on the conveyors 161 is released so that the case is then moved through a spring loaded stop to the conveyor stops 176 in the squaring station F. Here, the photoelectric sensor 169 detects the presence of the container 100 and applies the conveyor brake and actuates a squaring assembly including a squaring ram 200 carried on the frame above the conveyor 150 in station F so as to reciprocate the squaring die 201 downwardly and then upwardly. The squaring die 201 includes a rectangular die carrying head 202 having upturned side flanges 203.

The head 202 is provided with a plurality of slots 203 through which the bolts 205 project for securing the lugs or dies denoted generally by numeral 206, to the head 202. Each die 206 is for being received in the corner portion of the container and has a flat base 207 through which the bolts 205 project. Extending downwardly from the base 207 is a flat, transversely disposed flap presser plate 208, the lower end portion of which is provided with an inwardly bent camming flange 209. There are four dies or lugs 206, one for each corner of container 100 so that they face one end of conveyor 150 and and two face the opposite end of the conveyor 150. The flap camming flanges 209 for the rear pair of dies 206 are aligned transversely as are the other two front flaps camming flanges 209, these pairs of flanges tapering downwardly. The inner edges of the die plates 208 are provided with reinforcing plates 210 perpendicular to plates 208, the plates 210 being in spaced parallel relationships in longitudinal planes so as to straddle the central partition member formed by the panels 13 and 14 as the dies 206 move downwardly and upwardly. Each plate 210 is fixed to plate 208 along a common corner edge 212. Camming flanges 211 protrude or taper inwardly and downwardly from the lower edges of plates 210 and are joined to flanges 209 along inwardly tapering common edges.

Carried by the inner surfaces of plates 208 are spring supporting blocks 214 which respectively carry the proximal ends of downwardly extending leaf springs 213. The lower ends of springs 213 carry transversely extending stubs shafts 215, which in turn carry camming rollers 216, the outer peripheries of which protrude outwardly of plates 208 for yieldably engaging the flaps **16*a*, 16*b*, 17*a*, and 17*b* for urging the same flat against the inner surfaces of the end walls 151 of the container 100. Thus, the partition member formed by the panels 13 and 14 is positoned parallel to the side walls 140 of container 100**.

The electrical and pneumatic circuitry employed for actuating the various elements hereinabove described are conventional and hence no more detailed description of the same is deemed necessary.

It will be obvious to those skilled in the art that many variations may be made in the embodiments here chosen for the purpose of illustrating the present invention without departing from the scope thereof as defined by the appended claims.

What is claimed is:

1. Apparatus for inserting partitions, each having a central partition member, into open containers, each container of which has opposed spaced parallel end walls and opposed spaced parallel side walls forming a rectangular perimeter:

(a) means for conveying said containers successively along a prescribed path through a partition inserting station;

(b) means for moving said partitions respectively into said containers in said station with the partition member of each partition disposed at a sufficient angle with respect to the sides of its container that it is loosely received in its container; and occupies less space lengthwise from end wall to end wall in its container than the partition does when it is parallel to the side walls of its container.

(c) twist means for twisting each of said partitions, after insertion into said container, for rotating said partition member from its loose angled position about parallel to the side walls of its container.

2. The apparatus defined in claim 1 wherein said partition includes flaps protruding sidewise from said partition member and including means insertable into said container for urging said flaps against the inside surfaces of said container after said partition has been substantially fully inserted into said container and twisted therein.

3. The apparatus as defined in claim 1 wherein said partition member is a rectangular blank and includes a pair of panels joined along a common transverse edge and including means for holding said partition with its side edges angled with respect to the path of travel of said container and means for folding said partition member at its common transverse edge along a line perpendicular to its side edges prior to insertion of said partition into said container.

4. The apparatus as defined in claim 3 wherein said partition member is initially in a flat condition and has flaps extending sidewise from said panels and including means for folding said flaps outwardly of said panels and additional means for then folding said flaps back toward said panels prior to the insertion of said partition into said container.

5. The apparatus as defined in claim 4 wherein said folding means includes means for initially folding the flaps in the same direction from said panels, prior to the time that the panels are folded along the common transverse edge.

6. The apparatus as defined in claim 5 including additional means for folding said flaps to acute angles with respect to said panels, after said panels have been folded along their common transverse edge.

7. The apparatus defined in claim 6 including means for urging said flaps against the inner surfaces of said container after said partition has been inserted into said container.

8. The apparatus as defined in claim 7 wherein said means for urging said flaps includes camming surfaces reciprocatable into and out of said container inwardly of said flaps for engaging said flaps and moving them outwardly with respect to said container.

9. Apparatus for inserting partitions, each having a central partition member, into open containers comprising:

(a) means for conveying said containers successively along a prescribed path through a partition inserting station;

(b) means for moving said partitions respectively into said containers in said station, with the partition member of each partition angling with respect to the sides of its container; and (c) twist means for twisting each of said partitions, after insertion into said container, for rotating said partition member from its angled position to a position about parallel to the side walls of its container;

(d) said twist means including a pair of opposed fingers having camming means for rotating said fingers as said partition member passes therethrough and spring means for returning said fingers so as to rotate said partition member during the last portion of its travel through said finger means.

10. Apparatus for inserting partitions, each having a central partition member, into open containers comprising:

(a) means for conveying said containers successively along a prescribed path through a partition inserting station;

(b) means for moving said partitions respectively into said containers in said station, with the partition member of each partition angling with respect to the sides of its container; and (c) twist means for twisting each of said partitions, after insertion into said container, for rotating said partition member from its angled position to a position about parallel to the side walls of its container;

(d) said partition includes a pair of panels initially disposed along a common plane and separated from each other by a common transverse edge, and including means for folding said panels along said common edge and against each other, said means including camming surfaces for urging said panels together to form said partition member, means for holding said panels in contiguous relationship during a portion of said movement and wherein said twist means includes spring biased fingers disposed in the path of travel of said partition member, said fingers having camming means by which said fingers are urged to a twisted position by the movement of said partition member and thereafter twist said partition member when said partition member has cleared the holding means.

11. An apparatus for forming, from a flat partition blank, an H-shaped partition, said partition blank having a pair of panels connected by a common transverse score line and flaps extending sidewise from opposite sides of said panels, said flaps being divided from said panels by parallel longitudinal score lines, and for inserting the H-shaped partition into an open rectangular container, said apparatus comprising:

(a) magazine means for supporting a plurality of said blanks;

(b) feed means for feeding said blanks one at a time from said magazine means along a first linear prescribed path;

(c) conveyor means for receiving the blanks fed by said feed means and for feeding said blanks successively along said first prescribed path;

(d) flap folding means for folding said flaps along said longitudinal score lines to angular positions with respect to said panels;

(e) panel folding means for folding said panels along said transverse acore line to a position adjacent to each other with the panels protruding outwardly therefrom;

(f) means in said first prescribed path for urging said panels into contiguous relationship to form a partition member;

(g) container conveyor means for conveying successive open rectangular containers along a second linear prescribed path arranged at an acute angle to said first prescribed path for positioning said containers for respectively receiving said partitions;

(h) means in said first prescribed path for respectively inserting said partitions into said containers with their panels generally diagonal to such containers when such containers are positioned by said container conveyor to receive said partitions; and (i) straightening means for straightening the position of said partition within said container for disposing said panels parallel to the walls of said containers.

12. The apparatus as defined in claim 11 where said straightening means includes twist means disposed in said first prescribed path, and wherein said container conveyor is positioned angularly with respect to the plane of the folded panels so that said panels are received into said containers angularly with respect to the walls of said container and wherein said twist means twist each of said partitions after each has been only partially inserted into its container so as to position said panels thereof parallel with the side walls of said container.

13. The apparatus defined in claim 12 wherein said flap folding means includes a pair of folding plows disposed on opposite sides of said conveyor means for folding all of said flaps in the same direction as said partition moves along its prescribed path.

14. The apparatus defined in claim 13 including carrier means cooperating with said panel folding means for receiving said blank by its flaps, after said flaps have been folded and for releasing said flaps as said panels are folded about their common transverse score line.

15. The apparatus defined in claim 14 wherein said flap folding means includes finger means about which said panels are folded and means for withdrawing said finger means to release the blank after the same has been folded.

16. The apparatus defined in claim 11 wherein said means for inserting said partitions into said container includes means for conveying said partition downwardly toward said container conveyor means for inserting said blanks into said containers with the panels angled with respect to the walls of said container and wherein said straightening means includes twist means for thereafter rotating said blank and said container with respect to each other during the insertion of the folded blank into said container.

17. The apparatus defined in claim 11 wherein said straightening means includes a squaring head movable after said panels are parallel to said walls into and out of said container and camming lugs carried by said squaring head for engaging the inner surfaces of said flaps and for urging the same outwardly into contiguous relationship with the inner surfaces of the end walls of said container.

18. Apparatus for inserting partitions into open containers disposed in a petition insertion station, comprising:

(a) a linear container conveyor for conveying successive rectangular containers with their upper ends open along a path of travel with their side walls disposed about parallel to the path of travel into and out of said partition insertion station;

(b) a linear partition conveyor above said container conveyor for feeding successive flat rectangular partition blanks along a linear path of travel with the side edges of said blanks parallel to the path of travel of said partition, said blanks each being scored to provide juxtaposed panels joined along a common edge which is transverse to the path of travel of said blanks, said blanks each being cut and scored to provide opposed flaps connected along score lines on opposite sides of said blank to said panels so that, when said panels are folded against each other and said flaps folded outwardly of said panels, an H partition is formed;

(c) first fold means on opposite sides of said partition conveyor for folding said flaps from the plane of each blank;

(d) folding means at the end of said partition conveyor for folding successive blanks so that said panels of each blank are folded about said traverse score line to positions adjacent to each other;

(e) means for holding the folded panels of successive blanks in planes angularly disposed to said walls of said containers, above the partition insertion zone of said container conveyor and generally perpendicular to the path of travel of said blanks;

(f) means for moving the held successively folded blanks downwardly and into successive of said containers in said partition insert station so that each partition is inserted generally in a diagonal fashion partially into a container; and (g) finger means for engaging each such partition and for rotating of the same along a vertical axis from its angled position to a position in which the panels of said blank are about parallel to the side walls of its container.

19. The apparatus defined in claim 18 including second fold means along the downward path of travel of said blank for further folding said flaps so that said flaps are at acute angles folded back toward their panels when the partition is inserted into its container.

20. The apparatus defined in claim 19 wherein said second fold means includes U-shaped dies moveable toward and away from the ends of the panels of each container.

21. The apparatus defined in claim 19 including a reciprocable squaring head, squaring lugs carried by said squaring head, said head being moveable toward and away from said container conveyor to insert said lugs into each container and move said flaps from their acute angular position to positions flat against the inner surfaces of the end walls of their container.

* * * * *